US010661466B2

(12) United States Patent
Mayer et al.

(10) Patent No.: US 10,661,466 B2
(45) Date of Patent: May 26, 2020

(54) SLICING DEVICE

(71) Applicant: Textor Maschinenbau GmbH, Wolfertschwenden (DE)

(72) Inventors: Josef Mayer, Memmingerberg (DE); Jorg Schmeiser, Wiggensbach (DE)

(73) Assignee: Textor Maschinenbau GmbH (DE)

( * ) Notice: Subject to any disclaimer, the term of this patent is extended or adjusted under 35 U.S.C. 154(b) by 92 days.

(21) Appl. No.: 14/435,523

(22) PCT Filed: Oct. 14, 2013

(86) PCT No.: PCT/EP2013/071397
§ 371 (c)(1),
(2) Date: Apr. 14, 2015

(87) PCT Pub. No.: WO2014/060340
PCT Pub. Date: Apr. 24, 2014

(65) Prior Publication Data

US 2015/0283721 A1 Oct. 8, 2015

(30) Foreign Application Priority Data

Oct. 16, 2012 (DE) ..... 10 2012 218 853

(51) Int. Cl.
*B26D 7/26* (2006.01)
*B26D 1/14* (2006.01)
(Continued)

(52) U.S. Cl.
CPC ..... *B26D 7/2621* (2013.01); *B26D 1/14* (2013.01); *B26D 1/25* (2013.01); *B26D 1/28* (2013.01);
(Continued)

(58) Field of Classification Search
CPC ..... Y10S 83/932; B26D 2210/02; B26D 2210/04–08; B26D 1/0006; B26D 1/143–1535; B26D 1/25; B26D 1/26; B26D 1/28; B26D 1/29; B26D 2001/0046; B26D 2001/006; B26D 1/14; B26D 7/26;
(Continued)

(56) References Cited

U.S. PATENT DOCUMENTS 2,752,968 A 7/1956 Toby et al.
2001/0054345 A1* 12/2001 Krauss ..... B26D 1/16 83/703
(Continued)

FOREIGN PATENT DOCUMENTS

DE 154952 C 1/1904
DE 10030691 A1 1/2002
(Continued)

OTHER PUBLICATIONS

International Preliminary Report on Patentability for International application No. PCT/EP2013/071397 dated Apr. 21, 2015.

*Primary Examiner* — Evan H MacFarlane
(74) *Attorney, Agent, or Firm* — Dickinson Wright PLLC

(57) ABSTRACT

A slicer having at least one cutting blade, in particular a scythe-like blade, rotating about an axis of rotation and having an imbalance. Also included is a rotary drive for the cutting blade. Further included is a counterweight having at least one balance mass for compensating the imbalance of the cutting blade.

14 Claims, 5 Drawing Sheets

Figure 1:
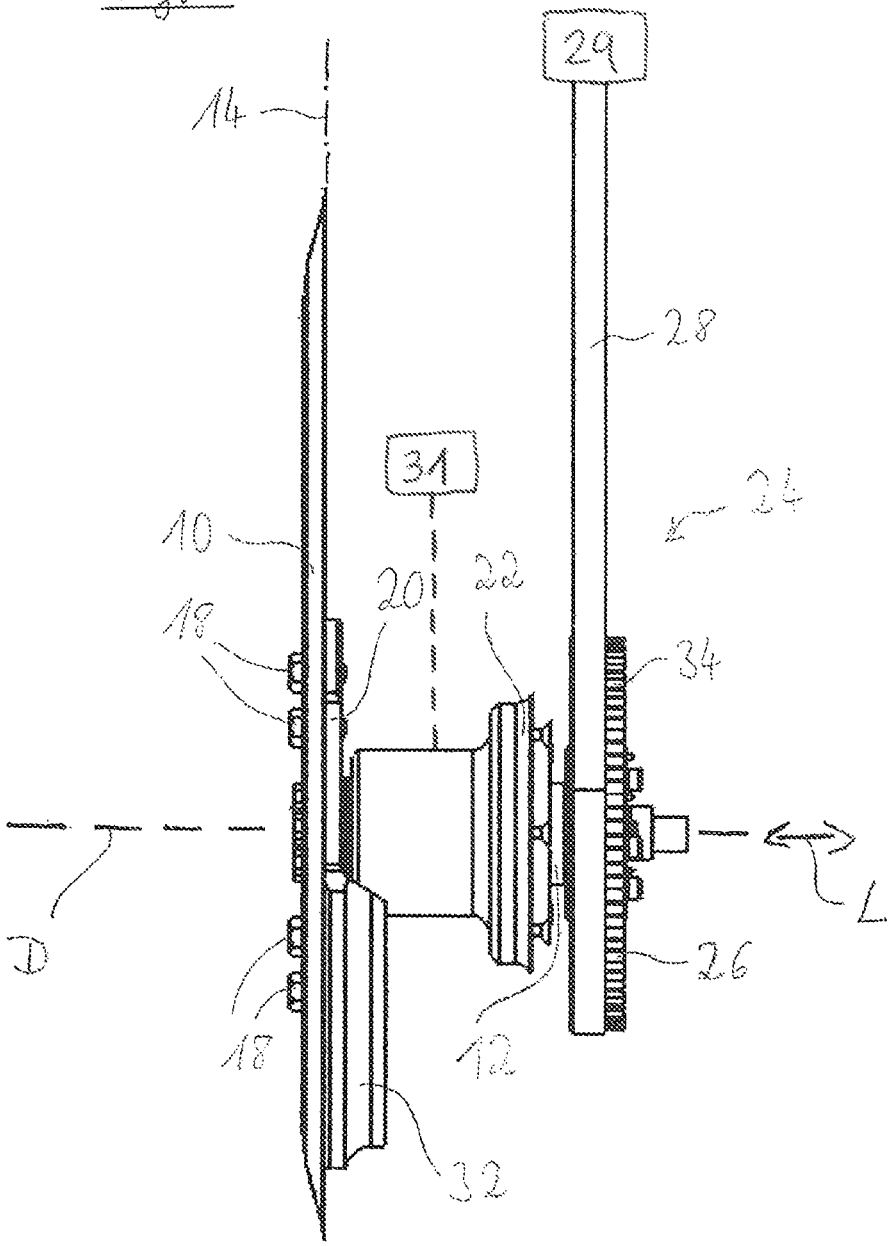

(51) Int. Cl.
*B26D 1/25* (2006.01)
*B26D 1/28* (2006.01)
*B26D 1/00* (2006.01)

(52) U.S. Cl.
CPC .... *B26D 7/2614* (2013.01); *B26D 2001/0046* (2013.01); *B26D 2210/02* (2013.01); *B26D 2210/08* (2013.01); *Y10T 83/8789* (2015.04)

(58) Field of Classification Search
CPC .... B26D 7/2614; B26D 7/2621; A21C 15/04; F16F 15/322; Y10T 83/8789
USPC ..... 74/572.4, 570.1
See application file for complete search history.

(56) References Cited

U.S. PATENT DOCUMENTS

2004/0082283 A1* 4/2004 Lindell ..... B24B 23/02 451/343
2007/0028742 A1* 2/2007 Mueller ..... B26D 1/157 83/676
2010/0192745 A1* 8/2010 Weber ..... B26D 7/2635 83/508.2
2011/0247466 A1* 10/2011 Weber ..... B26D 7/2635 83/13

FOREIGN PATENT DOCUMENTS

DE 202004013648 U1 * 11/2004 ..... A21C 15/04
DE 10333661 A1 2/2005
DE 102008019776 A1 10/2009
DE 102008020293 A1 * 10/2009 ..... B26D 7/2614
DE 102009048056 A1 4/2011
EP 0738566 A2 10/1996
WO 2010011237 A1 1/2010

* cited by examiner

SLICING DEVICE

CROSS-REFERENCES TO RELATED APPLICATIONS

This application is a National Phase Application of Patent Application PCT/EP2013/071397, filed on Oct. 14, 2013, which claims priority to German patent application no. 102012218853.3, filed on Oct. 16, 2012, both of which are incorporated herein by reference, in their entirety.

The invention relates to an apparatus for slicing food products, in particular to a high-performance slicer, having at least one cutting blade rotating about an axis of rotation and having an imbalance; having a rotary drive for the cutting blade which is arranged at a drive side of the cutting blade; and having a counterweight comprising at least one balance mass for compensating the imbalance of the cutting blade.

With such slicing apparatus, which are also called slicers, scythe-like blades can be used which rotate at a speed of around 600 to 2,500 revolutions per minute.

With a scythe-like blade, the slicing of the products takes place with the aid of the geometry of the blade. A planetary motion of the blade such as with a circular blade is not necessary.

For this purpose, the scythe-like blade has a contour which is asymmetrical with respect to the axis of rotation. The center of gravity of the blade, i.e. the center of mass of the blade, is therefore displaced with respect to the axis of rotation. An imbalance with a specific imbalance mass or imbalance position thus results in accordance with the blade mass, the blade shape and/or the blade contour. To ensure a vibration-free running of the blade, in particular at the high speeds which occur, such a slicing apparatus must be balanced in all planes.

It is known to arrange counterweights both in front of the blade and behind the blade. A balancing in a radial plane and in an axial plane can thereby be ensured. A wobbling of the blade can be suppressed in this manner.

FIG. 44 B of WO 2010/011237 A1 shows two counterweights of which, viewed in the axial direction, one counterweight is arranged in front of the blade and one counterweight is arranged behind the blade.

It is disadvantageous in this respect that a replacing of the blade, which is frequently required in practice, makes it necessary to remove the counterweights. In particular the counterweight located in front of the blade has to be removed on every change and subsequently has to be reinstalled again. This is associated with a substantial time effort and is thus uneconomic and unergonomic.

DE 10 2008 019 776 A1 describes a blade having a large central opening. The blade is pushed over a counterweight of blade mount for installation. The counterweight is thus located in front of the cutting blade in the cutting position. The manufacture of such a slicing apparatus and of the corresponding blades is, however, comparatively expensive due to the complex construction.

The term "imbalance" is to be understood in the following, also generally in dependence on the context, as an imbalance mass, an imbalance location and/or a force effective in the rotation, with respect to magnitude and direction, due to the imbalance mass Axial spacings, that is spacings measured along the axis of rotation of the blade, relative to a cutting blade relate here, if not otherwise stated, to a cutting plane defined by the blade, whereas the axial location of a balance mass or of an imbalance relates to a plane which extends perpendicular to the axis of rotation of the blade and in which the center of mass of the balance mass or imbalance lies. Indications on the location or direction of effect of a balance mass here generally also relate, if not otherwise stated, to the imbalance generated by the balance mass or by the component or assembly in which the respective balance mass is integrated.

If an integration of a balance mass into a component or assembly of the apparatus is understood in the sense of a direct addition of an additional mass, it is clear for the skilled person that this is the same as a direct removal of material from a component or assembly, in mathematical terms therefore with a direct addition of a "negative balance mass", that is generally with the direct generation of an imbalance at or in the respective component or assembly.

It is an object of the invention to compensate an imbalance of a cutting blade of a slicing apparatus in a simple and inexpensive manner, wherein in particular the handling of the apparatus should be particularly favorable in a hygienic respect.

This object is satisfied by an apparatus having the respective features of the independent claims. The invention covers a plurality of independent aspects in accordance with the independent claims which are explained in more detail in the following and which can generally also be combined with one another as desired within the framework of the invention. Protection is likewise claimed for combinations of these aspects.

In accordance with an aspect of the invention, the counterweight is arranged solely at one side of the cutting blade.

In accordance with the invention, in particular all the balance masses are only arranged at one side of the cutting blade, i.e. the invention represents a turning away from the balance concepts known from the prior art in which the counterweight is split over both blade sides, that is at least one balance mass is arranged in front of the blade and at least one further balance mass is arranged behind the blade. The advantages which result from the balance concept in accordance with the invention will be looked at in more detail in the following.

The side at which the counterweight is located can be the drive side of the blade depending on the respective slicer concept. This is, however, not compulsory. The side of the counterweight can also be blade side from which the products are supplied to the blade. In dependence on the design of the respective slicer, this supply side can be identical to the drive side, with this not being compulsory, however. Provision is in particular made in accordance with the invention that all the balance masses are not located at the side of the blade which is provided for a removal of the blade, i.e. viewed from the removal side of the blade, all the balance masses are located at the other side of the blade. If the blade has e.g. to be removed to the front, all the balance masses are located behind the blade so that no balance mass has to be moved for a removal of the blade.

No balance mass is thus provided at the removal side of the blade. Components which may be located at this side, for example a part of a hub or fastening means, e.g. screws, in this respect only serve for the fastening of the cutting blade or for other purposes, but not for the compensation of the imbalance of the cutting blade. The side of the blade free of balance mass, in particular the removal side, that is, can be identical to the side at which the sliced products are transported away, but with this not being compulsory and being dependent on the respective slicer concept. There are slicer concepts in which the drive side and the removal side of the blade lie at the same blade side and thus opposite the product supply side.

Since in this respect no counterweight is required at one side of the cutting plane—that is in particular at the removal side of the cutting blade—no components serving as imbalance masses have to be removed in a complex manner, for example by the use of tools for the removal of the blade. The standstill times, e.g. due to maintenance work, are thus considerably reduced, whereby costs can be saved.

The counterweight is generally matched to the blade mass or blade shape which determines the imbalance of the cutting blade.

The complete arrangement in accordance with the invention of the counterweight, that is of all provided balance masses, only at one side of the blade furthermore allows or facilitates particularly advantageous balance concepts which will be looked at in more detail in the following in connection with further independent aspects of the invention.

In accordance with an aspect of the invention, the cutting blade is removably attached to a blade mount. The blade mount forms a balance mass and has an asymmetrical rotation geometry with respect to the axis of rotation.

It is in this respect the blade mount itself which forms a balance mass serving for the balancing of the blade. This concept makes it possible to position the required balance mass axially close to the blade, on the one hand, and radially relatively far to the outside, on the other hand, which makes a particularly efficient balance concept realizable overall. A sufficiently large imbalance can be generated by the symmetrical design of the blade mount with a relatively small total weight of the blade mount.

This shape of the blade mount, which is asymmetrical with respect to the axis of rotation, represents a moving away from concepts for the blade mount known from the prior art in which it is of decisive importance to provide a blade mount with a rotation geometry symmetrical with respect to the axis of rotation, in particular with a circular outer contour concentric with the axis of rotation, which is necessary to seal a correspondingly circular opening in a housing or rack of the slicer or to form a narrow ring gap with this opening.

In accordance with the invention, the blade mount can deviate extremely from a circular outer contour and can so-to-say be designed very top-heavy—with respect to the radial direction, i.e. it can have a relatively large imbalance or imbalance mass, for example—in figurative terms—like a rotating hammer, in favor of a balance mass disposed as far radially outwardly as possible.

In this respect, the blade mount can e.g. comprise a first section and a second section, wherein the first section forms the largest radius of the blade mount, the axis of rotation extends through the second section and the center of mass of the first section is disposed radially further outwardly than the center of mass of the second section. The blade mount can e.g. in particular be shaped at least approximately in the manner of an anchor overall, with a relatively heavy circular ring section being arranged radially outwardly at a comparatively light central section through which the axis of rotation extends. Depending on the magnitude of the required imbalance, the outer circular ring section can, for example, extend over at least 1/7, 1/6. 1/5, 1/4 or 1/3 of the outer periphery of the blade mount.

Since the blade mount itself forms a balance mass, the design is particularly simple. The balance mass is additionally located axially particularly close to the cutting plane in this manner. A further, separate balance mass in the axial vicinity of the cutting blade is thus not necessary. The blade mount therefore satisfies a dual function since it carries the blade, on the one hand, and compensates at least a portion of the imbalance of the cutting blade, on the other hand.

On a replacement of a blade with a blade of a different diameter and thus of a different imbalance, only the blade mount has to be replaced. The slicing apparatus can thus be adapted particularly simply to different applications. Blades of different sizes can thereby be used in a simple manner.

Since only the blade mount has to be replaced, the further components of the slicing apparatus can be retained. An optionally additionally provided further balance mass can in particular remain in the same position.

In accordance with an aspect of the invention, the balance mass or one of the balance masses is formed by the rotary drive, in particular by a drive disk or by a hub which can be set into rotation by means of a drive motor via a drive belt.

In this manner, the rotary drive satisfies a dual function since it sets the cutting blade into rotation, on the one hand, and balances at least some of the imbalance of the cutting blade, on the other hand.

In other words, in accordance with an aspect of the invention, due to the balance mass or the imbalance, the rotary drive together with the cutting blade forms a mass system which can be configured with respect to dimensioning and arrangement such that the total center of mass of the rotating system is located at that side of the cutting blade at which the rotary drive is also disposed. In other words, this center of gravity is "pulled" to the side of the rotary drive by the imbalance therein. It is consequently possible likewise to arrange a further balance mass at this side of the cutting blade so that all the balance masses are located at only one side of the cutting blade. Since the total center of mass is hereby caused to "migrate" to the side of the rotary drive, it is no longer necessary to arrange balance masses at both sides of the blade or of the imbalance of the blade.

The balance mass of the rotary drive can be arranged at a large axial distance from the cutting plane with respect to the axial length of the total arrangement—measured between the cutting plane and the plane of the rotary drive. A relatively large lever effect of the balance mass so-to-say results from this which thus itself only has to have a comparatively small weight, which in turn in practice facilities its integration into the rotary drive or only makes it possible at all.

In combination with a balance mass formed by the blade mount and thus located extremely close to the cutting plane, the balance mass formed by the rotary drive can effect an ideal balancing of the rotating total system in all planes and both statically and dynamically and it can do this with an extremely compact design of the total arrangement.

It is a further advantage that a blade having a different size and thus a different imbalance can be balanced by modifying the rotary drive, for example by a replacement of the drive disk or of the hub. A blade mount itself, which optionally serves as a balance mass in addition to the rotary drive, does not necessarily have to be replaced in this respect, with it, however, being possible on a blade change to change both the blade mount and the drive disk or the hub and the latter in particular when it is not possible or not desired to compensate the change of the imbalance to be compensated associated with a blade change solely by replacing the blade mount.

The drive disk can, for example be a toothed belt disk which is set into a rotary movement via a motor-driven toothed belt. The drive disk can e.g. drive a shaft which carries the blade mount and thus the blade and sets in into rotation and which is rotatably supported in a fixed-position hub. Alternatively to or instead of a drive disk, a hub, in particular a hollow cylindrical hub, can be provided which is e.g. set into a rotary motion via a motor-driven toothed belt and carries the blade mount and thus the blade and sets it into rotation, with the hub being rotatably supported on a shaft or on a spindle which is itself rotatable relative to the blade. The driven shaft or the driven hub can carry the blade mount formed as a separate component or can itself be formed as a blade mount. If a rotary-driven hub is simultaneously configured as a blade mount, the hub can respectively include a balance mass or act as an imbalance at at least two axially spaced apart points to compensate the imbalance of the blade. The counterweight formed by the imbalance masses or by the imbalances is in this respect provided by a single component—namely the blade which is rotary-driven, on the one hand, and which has the imbalance to be compensated, on the other hand—which is arranged at a side of the blade so that all the balance masses provided to compensate the blade balance or all the imbalances only have to be arranged at one side of the blade in this variant, too.

The rotary drive is in particular axially spaced apart from the cutting blade, and indeed, for example, in a range between 150 mm and 500 mm, preferably from 150 mm to 300 mm.

Provision is in particular made in all aspects of the invention mentioned here that the counterweight does not only comprise a single balance mass, but rather a plurality of balance masses axially spaced apart from one another. Exactly two balance masses are in particular provided. Provision is made in a particularly preferred embodiment to arrange a balance mass axially close to the blade, for example in the form of a correspondingly asymmetrically configured blade mount and to position a further balance mass at a larger axial distance from the blade, for example in the rotary drive or as a component of the rotary drive.

The concept of a plurality of balance masses, in particular of two balance masses, in addition to the imbalance of the blade can advantageously make use of the circumstance, with a corresponding dimensioning and arrangement of the balance masses in dependence on the blade imbalance, that the center of gravity of the imbalance, on the one hand, and the centers of gravity of the individual balance masses, on the other hand, always strive toward a common center of gravity of the total rotating system.

In accordance with an aspect of the invention, a counterweight is provided for balancing the imbalance of the cutting blade, said counterweight comprising at least two balance masses axially spaced apart from one another. A first balance mass and the imbalance of the cutting blade act at least approximately in opposite radial directions, whereas a second balance mass acts at least approximately in the same radial direction as the imbalance of the cutting blade. In this respect, the first balance mass is arranged closer to the cutting blade in the axial direction than the second balance mass.

Due to the geometrical arrangement of the balance masses, a system balanced both statically and dynamically in all planes an also be realized with a slicer of comparatively compact and relatively simple design.

Further developments of the invention can also be seen from the dependent claims, from the description and from the enclosed drawings.

In accordance with an embodiment, a first balance mass is arranged at an axial spacing from the cutting blade which is smaller by a multiple than the axial spacing of a second balance mass from the cutting blade.

The first balance mass is in particular located very close to the cutting blade and can e.g. be integrated into a blade mount, can be a component of the blade mount or can be formed by the blade mount.

The second balance mass can be selected as relatively small with a comparatively large axial spacing of the second balance mass from the cutting blade due to the relatively large lever effect thereby present. Only a small mass thereby has to be accelerated or set into rotation.

In accordance with a further embodiment, a first balance mass (or its imbalance or the imbalance of a component or assembly comprising the first balance mass) is arranged at an axial spacing from the cutting blade of a maximum of 50 mm, 40 mm, 35 mm, 30 mm or 25 mm, preferably of a maximum of 20 mm. A second balance mass (or its imbalance or the imbalance of a component or assembly comprising the second balance mass) is arranged at an axial spacing from the cutting blade of 100 mm to 2,000 mm, in particular of 150 mm to 500 mm, in particular preferably of 150 mm to 300 mm.

The spacing between the first balance mass and the second balance mass can, for example, amount to at least 50 mm, 75 mm, 100 mm, 150 mm, 200 mm, 300 mm, 500 mm, 1,000 m, 1,500 mm or 2,000 mm.

In accordance with a further embodiment, a first balance mass or its imbalance is greater than the imbalance of the cutting blade. The sum of the imbalance of the cutting blade and a second balance mass or its imbalance is in particular equal to or approximately equal to the first balance mass or its imbalance.

In accordance with a further embodiment, a first balance mass extends up to a radial spacing from the axis of rotation which amounts to at least 75%, in particular 90%, and preferably at least approximately 100% of the smallest radius of the cutting blade, wherein in particular the first balance mass is arranged closer to the cutting blade in the axial direction than a second balance mass.

In accordance with a further embodiment, the largest radius of the blade mount amounts to at least 75%, in particular 90%, and preferably at least approximately 100%, of the smallest radius of the cutting blade. In accordance with the invention, the blade mount can consequently extend in at least a part region of its periphery in the radial direction up to the smallest radius of the cutting blade, which is not possible with arrangements known from the prior art due to an overall concept which is basically different from the invention. This is e.g. the case when the blade mount has to close a comparatively small housing opening or rack opening and therefore has to have a circular shape with a relatively small radius or when the blade has a comparatively large opening for attaching the blade mount.

The first balance mass is in this manner located radially relatively far to the outside, i.e. it is spaced apart relatively far from the axis of rotation of the cutting blade. The first balance mass can hereby be comparatively small. This in turn makes it possible to position the first balance mass comparatively close to the imbalance of the blade in the axial direction and thus close to the cutting plane. In this manner, a second balance mass can also be selected as comparatively small and this can be done the more, the further the second balance mass is axially remote from the cutting blade.

Only relatively small masses therefore have to be moved due to such an arrangement of the balance masses. This is particularly advantageous both for the rotary movement of the blade and for an axial blade movement optionally required during the rotary movement, in particular for a clocked axial movement for carrying out blank cuts. The dimensioning and the regulation of the rotary and axial drives can thereby also be optimized.

In a construction respect, such a balance concept in accordance with a preferred embodiment of the invention can be realized in a particularly simple, but nevertheless effective manner in that the first balance mass is formed by a blade mount and the second balance mass is formed by the rotary drive of the blade.

In accordance with a further embodiment, a blade mount and the rotary drive are arranged at different sides of a fixed-position rack part or frame part. The rack part or frame part in particular serves for the axially spaced apart fastening of the blade mount via a hub through which a drive shaft is guided which extends from the rotary drive to the blade mount.

In a possible further development, the blade mount is consequently spaced apart from the rack part or the frame part in the axial direction. In this manner, an intermediate space is present between the blade mount and the rack part or frame part.

In accordance with a further embodiment, a first balance mass and a second balance mass are arranged at different sides of a fixed-position rack part or frame part.

In accordance with a further embodiment, the rack part or frame part forms at least a part of an outer wall of a drive housing for the rotary drive facing the cutting blade.

The "second balance mass", as it is called above, which is disposed axially further remote from the cutting blade than the other balance mass is preferably arranged in a hygienically non-critical region, for example in a drive housing.

The apparatus in accordance with the invention is preferably configured such that a so-called fine-balancing can be carried out to be able to balance the system as exactly as possible. The fine balancing can e.g. take place by adding or removing small weights, in particular at or in the region of at least one balance mass anyway provided.

Whereas a fine balancing had previously always been carried out in the vicinity of the cutting blade, it is proposed in accordance with a preferred further development of the invention to carry out the fine balancing at or in the region of the balance mass disposed axially further remote from the cutting blade in the case of the provision of two balance masses, said balance mass in particular being the balance mass called the "second balance mass" above.

A possible advantage in this respect is that with a corresponding arrangement of the second balance mass, the fine balancing can take place in a hygienically non-critical region.

In accordance with a further embodiment, the rotating cutting blade is adjustable in the axial direction by means of an axial drive for carrying at out least one additional function, in particular for carrying out blank cuts and/or for setting a cutting gap. All the balance masses are in this respect adjustable together with the cutting blade.

All the balance masses are thus in particular also clocked in the case of an axial clocking of the blade in order to maintain an ideally balanced system in every axial position of the blade. The rotating system is thus always balanced in all planes in every axial position.

In accordance with a further embodiment, the cutting blade is removably attached to a rotor shaft which can be driven by means of the rotary drive and which carries a blade mount for the cutting blade or is configured as a blade mount, wherein the rotor shaft is led through a fixed-position rack part or frame part at whose one side the rotary drive is arranged and at whose other side the cutting blade is arranged.

In accordance with a further development, the rotor shaft is supported at a hub which is carried by the fixed-position rack part or frame part.

Provision can be made in this respect that the hub is disposed outwardly open and the bearing is sealed with respect to the environment between the hub and the rotor shaft. The seal can, for example, be a slipping seal, e.g. composed of a rubber material. This open arrangement does not preclude a protective hood being provided which at least partly surrounds the cutting region.

In accordance with a further embodiment, the hub extends in the axial direction between the fixed-position rack part or frame part and the cutting blade.

The imbalance of the cutting blade can be compensated in accordance with the invention by a specific geometrical arrangement of a plurality of balance masses, preferably of two balance masses, which can additionally be integrated in anyway present components of the slicer. The balance concepts in accordance with the invention also have the advantage, among many others, that no material having a high density, e.g. tungsten or lead, is required for the balancing. Due to the geometrical arrangement, comparatively small balance masses can namely be used and consequently standard materials such as stainless steel can be used.

Figure 2:
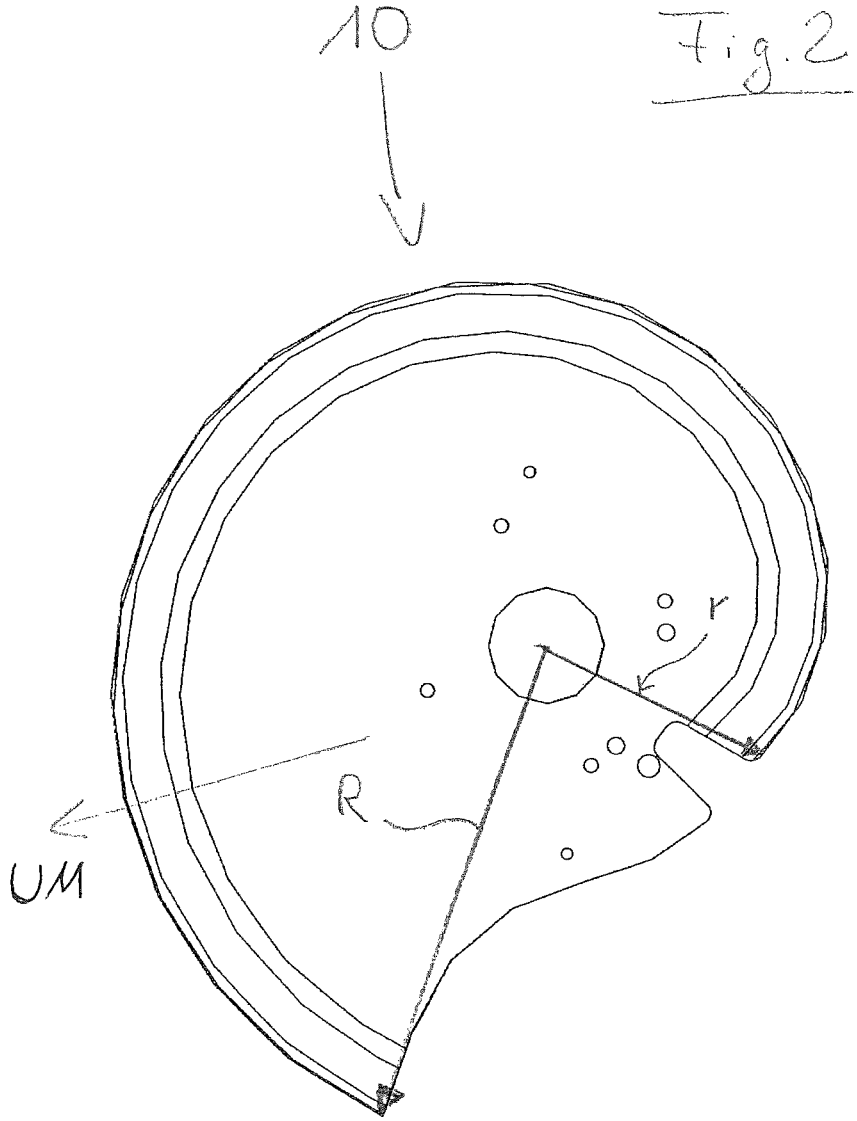
Figure 3:
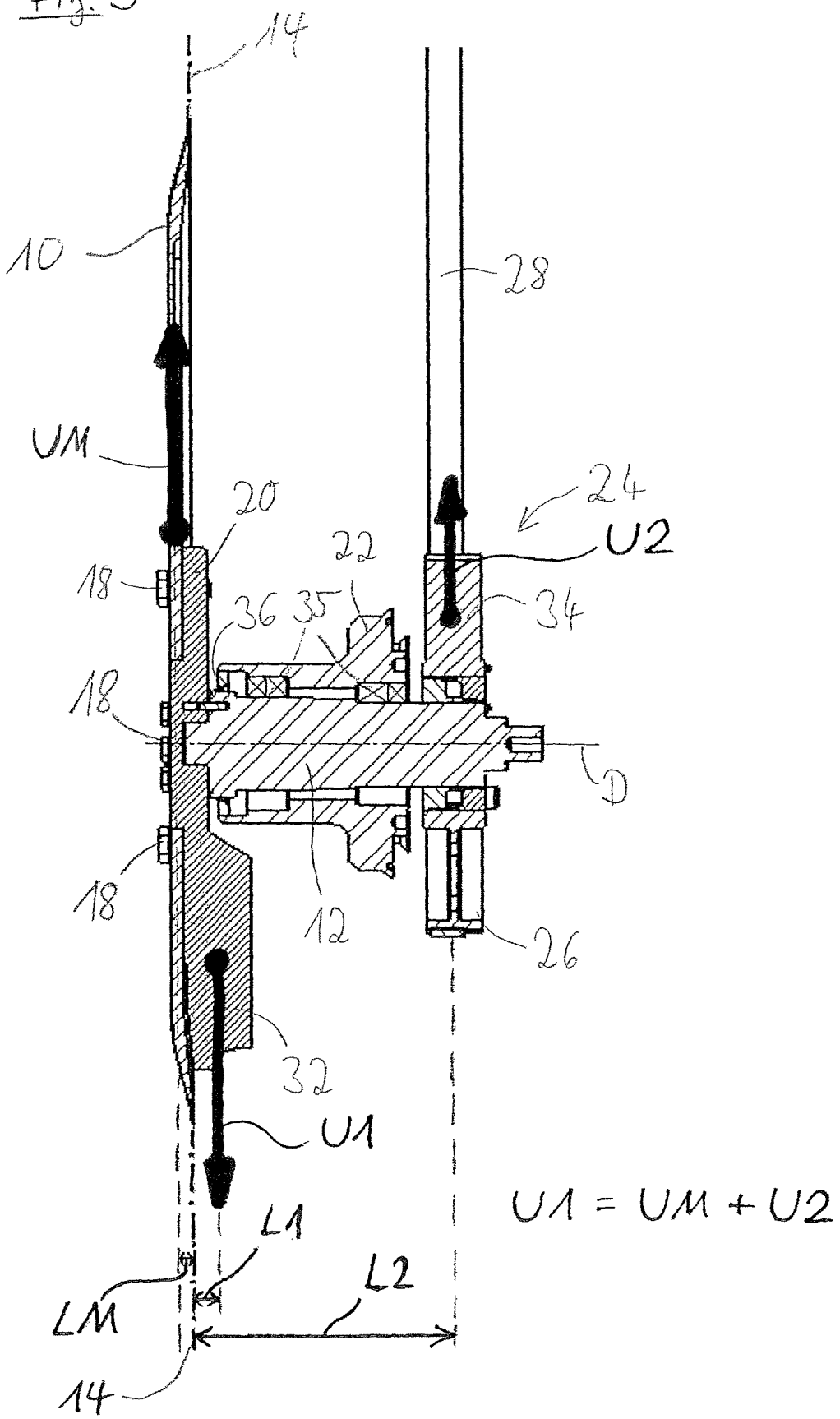
Figure 4:
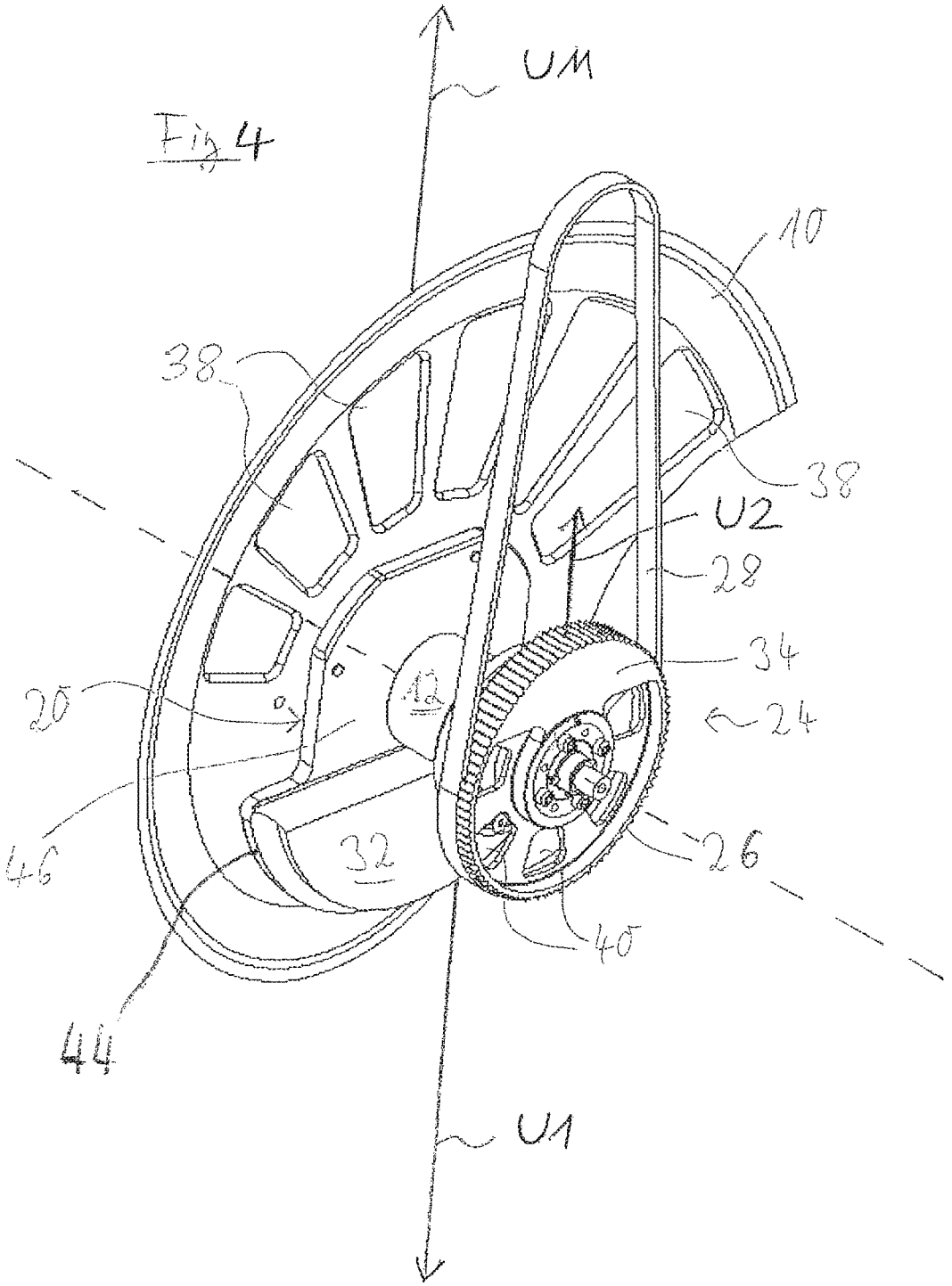
Figure 5:
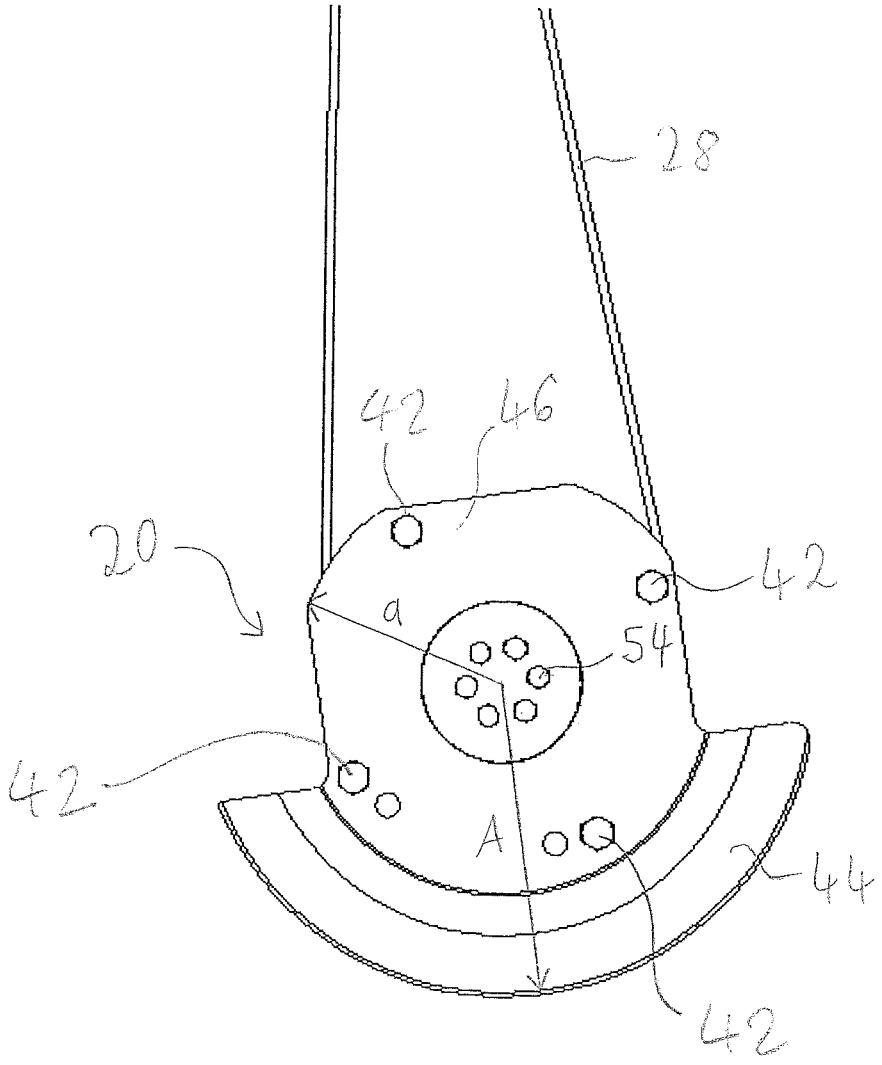

The invention will be described in the following by way of example with reference to the drawings. There are shown:

FIG. 1 in part a side view of an embodiment of a slicing apparatus in accordance with the invention;

FIG. 2 a scythe-like blade;

FIG. 3 a sectional view of the slicing apparatus in accordance with FIG. 1;

FIG. 4 a perspective view of the slicing apparatus in accordance with FIG. 1; and FIG. 5 a plan view of the blade mount of the slicing apparatus in accordance with FIG. 1.

FIG. 1 shows a part of the slicing apparatus (slicer) also called a blade head or cutting head for slicing food products, in particular sausage, ham or cheese.

A scythe-like blade 10 (cf. also FIG. 2) is attached rotatable about an axis of rotation D to a rotor shaft 12 which can be arranged inclined obliquely to the horizontal at least in cutting operation. The scythe-like blade 10 defines a cutting plane 14 which extends perpendicular to the axis of rotation D.

The scythe-like blade 10 is fixed to a blade mount 20 with the aid of screws 18. The scythe-like blade 10 is rotationally fixedly connected to the rotor shaft 12 via the blade mount 20. The rotor shaft 12 is in turn rotatably supported in a rotor hub 22 and is connected at its end remote from the blade 10 to a rotary drive 24. The drive takes place by means of a toothed belt disk 26 as a drive disk which is set into rotation via a drive belt 28 and which is rotationally fixedly connected to the rotor shaft 12. The belt 28 is driven by means of a motor 29. A rack part or frame part 31 of the slicer to which the hub 22 is fastened serves as a holder.

The axial spacing between the cutting plane 14 and the plane of the rotary drive 24 is bridged by the rotor shaft 12 and by the rotor hub 22 rotatably supporting the rotor shaft 12.

The scythe-like blade 10, which in particular has a weight of approximately 8 to 15 kg, is not rotationally fixedly shaped and consequently has an imbalance UM (cf. FIGS. 2 and 4). The blade 10 has a smallest radius r and largest radius R.

To compensate the blade imbalance UM and in particular to prevent a wobbling of the blade 10 during the rotation about the axis of rotation D, two axially spaced apart balance masses 32, 34 are provided which are each integrated into an anyway provided slicer component such that a compensation of the blade imbalance UM is achieved overall, with a small total weight of the counterweight formed by the balance masses 32, 34 and with an ideal utilization of space.

The blade mount 20 comprises the first balance mass 32 and thus effects a first imbalance U1 (cf. also FIGS. 3 and 4). The first balance mass 32 is arranged at the oppositely disposed side of the imbalance UM of the blade 10 with respect to the axis of rotation D (cf. FIG. 4) and is spaced apart so far radially from the axis of rotation D that the contour of the blade mount 20 which is formed by the balance mass 32 and which is the furthest outwardly radially lies in the vicinity of the smallest radius r of the blade 10. The largest radius of the blade mount 20 is thus substantially larger in relation to the smallest radius r of the blade than in blade mounts which are known from the prior art and which have a symmetrical rotation geometry, in particular a circular outer contour, with respect to the axis of rotation.

The center of mass of the blade mount 20 is consequently relatively far radially outwardly, with the radial position of the center of mass being selected—with respect to the largest radius of the blade mount 20—in dependence on the respective specific circumstances and is directly disposed at a relevant spacing from the axis of rotation D.

The blade mount 20 forming the first balance mass 32 or provided with the first balance mass 32 is configured overall such that a plane which includes the center of mass of the blade mount 20 and which extends perpendicular to the axis of rotation D, e.g. is no more than 20 mm axially remote from the cutting plane 14. A preferred region for this spacing L1 (cf. also FIG. 3) extends from approximately 10 mm to 25 mm.

The second balance mass 34 is integrated into the toothed belt disk 26. The second balance mass 34 is hereby spaced apart substantially further axially from the cutting plane 14 than the first balance mass 32 (cf. also FIG. 3). Both balance masses 32, 34 are located at the rear side of the cutting blade 10 with respect to the cutting plane 14, that is at the side—here coinciding with the side of the rotary drive 24—which is not the removal side or installation side of the cutting blade 10. The removal of the cutting blade 10 takes place to the left in FIG. 1, while the balance masses 32, 34 are arranged to the right of the cutting blade 10 in FIG. 1.

FIG. 3 shows a sectional view in accordance with FIG. 1. It can be seen in this that the second balance mass 34 or its imbalance U2 is located at the same side and in approximately the same angular position as the imbalance UM of the blade 10 with respect to the axis of rotation D. The second imbalance U2 is thus arranged rotated by approximately 180° with respect to the axis of rotation D with respect to the first imbalance U1 of the blade mount 20 provided with the first balance mass 32 (cf. also FIG. 4).

The respective spacings of the individual imbalances UM of the blade 10, U1 of the first imbalance 32 and U2 of the second imbalance 34, measured from the cutting plane 14, are designated by LM, L1 and L2 respectively. It can be recognized that L2 amounts to a multiple of L1 and to a multiple of LM and that LM and L1 are disposed in approximately the same order of magnitude.

A slipping seal 36 is provided to seal the bearings 35 which serve for the rotatable support of the rotor shaft 12 in the rotor hub 22.

FIG. 4 shows a perspective view of the slicing apparatus in accordance with FIG. 1. The scythe-like blade 10 and the toothed belt disk 26 each have pockets or cut-outs 38, 40, whereby the weight is reduced, on the one hand, and the mass distribution is directly influenced, on the other hand. In FIG. 4, the vectors are additionally drawn which illustrate the blade imbalance UM and the imbalances U1, U2 of the balance masses 32, 34.

FIG. 5 shows the blade mount 20 with a removed scythe-like blade 10. The blade mount 20 comprises boreholes 42 at which the scythe-like blade 10 is fastened by means of screws 18 (cf. FIG. 1) and boreholes 54 at which the blade mount 20 is fastened to the rotor shaft 12 at the end face.

In this embodiment, the radial displacement of the center of mass of the blade mount 20 is reached relatively far to the outside by an anchor-like or hammer-like embodiment A relatively heavy section 44, which forms the balance mass 32, in the form of a part circular ring<which extends around about a third of the outer periphery of the blade mount 20 has a larger outer radius A than a comparatively light central section 46 having an outer radius a which is moreover substantially thinner than the outer part circular ring section 44. The blade mount 20 is so-to-say comparable with a hammer with respect to the mass distribution in the radial direction, i.e. it is very top-heavy with a radially outwardly disposed head.

It can inter alia in particular be seen from FIGS. 1, 3 and 4 that the axial spacing between the two balance masses 32, 34 or the imbalances U1 and U2 is larger by a multiple than the axial spacing L1 between the first balance mass 32 or its imbalance U1 and the cutting plane 14.

It can already be seen from this that the invention is in particular based in the embodiment described here on a balance concept which is in particular characterized as follows by a combination of individual aspects:

- A first balance mass 32 is integrated into a blade mount 20 having a relatively large radial extent and can therefore be arranged axially very close to the blade 10, on the one hand, and radially relatively far to the outside, on the other hand. The first balance mass 32 can thereby be selected as comparatively small.
- A second balance mass 34 is arranged axially far remote from the blade 10 in comparison with the first balance mass 32. The second balance mass 32 can thereby also be selected as relatively small and much smaller than the first balance mass 32. This in turn allows the integration of the second balance mass 34 into the rotary drive 24 of the blade 10.

A combination of all these aspects or measures can be particularly advantageous in dependence on the specific circumstances of the respective slicer, but is not compulsory for the invention. Advantageous effects can also be achieved if not all of the measures described here are implemented together. Each aspect per se also brings about advantages.

The rotary drive 24 can be arranged in a housing which has a housing wall as a fixed-position rack part or frame part 31 which extends axially close to the rotary drive 24 perpendicular to the axis of rotation D at the side of the rotary rive 24 facing the blade 10. An axial drive L which is only indicated by a double arrow and which can generally be configured as desired can engage at the rotor shaft 12 and can be supported at this housing wall or at another point of the rack or frame 31.

If the scythe-like blade 10 is, for example, to be axially adjusted for carrying out blank cuts, the axial drive L is activated. The scythe-like blade 10 together with the blade mount 20 as well as all balance masses 32, 34 are in this respect adjusted together with the rotor shaft 12 relative to the housing wall or to the rack or frame and relative to the rotor hub 22. The drive belt 28 is slightly obliquely deflected on this movement.

The slicing apparatus in accordance with the invention is thus also always perfectly balanced and is balanced in all relevant planes and thus statically and dynamically on an axial movement of the blade 10. The arrangement in accordance with the invention of the balance masses 32, 34 also allows an extremely compact and thus space-saving construction of the rotor and of the slicing apparatus.

REFERENCE NUMERAL LIST

10 scythe-like blade
12 rotor shaft
14 cutting plane
18 screw
20 blade mount
22 rotor hub
24 rotary drive
26 toothed belt disk, drive disk
28 drive belt
32 first balance mass
34 second balance mass
35 bearing
36 seal
38 pocket
40 cut-out
42 borehole
44 first section
46 second section
54 borehole
D axis of rotation
R largest radius
r smallest radius
A radius of the first section
a radius of the second section
L axial drive
UM imbalance of the blade
U1 imbalance of the first balance mass 32
U2 imbalance of the second balance mass 34
LM spacing UM from the cutting plane 14
L1 spacing U1 from the cutting plane 14
L2 spacing U2 from the cutting plane 14

The invention claimed is:

1. An apparatus for the slicing of food products comprising:

at least one cutting blade rotating about a single axis of rotation and having an imbalance with respect to its rotational movement about the single axis of rotation;

a rotary drive for the at least one cutting blade; and a single counterweight that is the only counterweight of the apparatus and consists of a plurality of balance masses rotationally fixed to a rotor shaft and axially spaced apart from one another, each of the balance masses defining a circumferential and radial weight distribution that is static with respect to the rotor shaft, the plurality of balance masses being configured and arranged for compensating the imbalance of the at least one cutting blade with respect to its rotational movement;

wherein the plurality of balance masses includes a first balance mass and a second balance mass that are arranged only at one side of the at least one cutting blade, and wherein an axial spacing between the second balance mass and the at least one cutting blade is at least double an axial spacing between the first balance mass and the at least one cutting blade.

2. The apparatus in accordance with claim 1, wherein the imbalance of the first balance mass is larger than the imbalance of the at least one cutting blade.

3. The apparatus in accordance with claim 1, wherein the first balance mass and the imbalance of the at least one cutting blade act in opposite radial directions, whereas the second balance mass acts in the same radial direction as the imbalance of the at least one cutting blade.

4. The apparatus in accordance with claim 1, wherein the first balance mass and the second balance mass are arranged at different sides of a fixed-position rack part or frame part.

5. The apparatus in accordance with claim 1, wherein one of the balance masses is formed by the rotary drive.

6. The apparatus in accordance with claim 1, wherein the at least one cutting blade is adjustable in an axial direction for carrying out blank cuts and/or for setting a cutting gap, with each of the plurality of balance masses being adjustable together with the at least one cutting blade.

7. An apparatus for the slicing of food products comprising:

at least one cutting blade rotating about a single axis of rotation and having an imbalance with respect to its rotational movement about the single axis of rotation;

a rotary drive for the at least one cutting blade; and a single counterweight that is the only counterweight of the apparatus and consists of a plurality of balance masses rotationally fixed to a rotor shaft and axially spaced apart from one another, each of the balance masses defining a circumferential and radial weight distribution that is static with respect to the rotor shaft for compensating the imbalance of the at least one cutting blade, the plurality of balance masses comprising a first balance mass and a second balance mass, the axial distance between the first balance mass and the second balance mass being constant during slicing operation of the apparatus, wherein an axial spacing between the second balance mass and the at least one cutting blade is at least double an axial spacing between the first balance mass and the at least one cutting blade, and wherein the first balance mass and the imbalance of the at least one cutting blade act in opposite radial directions, whereas the second balance mass acts in the same radial direction as the imbalance of the at least one cutting blade.

8. The apparatus in accordance with claim 7, wherein the counterweight is arranged only at one side of the at least one cutting blade.

9. The apparatus in accordance with claim 7, wherein the imbalance of the first balance mass is larger than the imbalance of the at least one cutting blade.

10. The apparatus in accordance with claim 7, wherein the first balance mass and the second balance mass are arranged at different sides of a fixed-position rack part or frame part.

11. The apparatus in accordance with claim 7, wherein one of the balance masses is formed by the rotary drive.

12. The apparatus in accordance with claim 7, wherein the at least one cutting blade is adjustable in an axial direction for carrying out blank cuts and/or for setting a cutting gap, with each of the at least two balance masses being adjustable together with the at least one cutting blade.

13. An apparatus for the slicing of food products comprising:

at least one cutting blade rotating about an axis of rotation and having an imbalance with respect to its rotational movement;

a rotary drive for the at least one cutting blade; and a single counterweight that is the only counterweight of the apparatus and consists of a plurality of balance masses rotationally fixed to a rotor shaft and axially spaced apart from one another, each of the balance masses defining a circumferential and radial weight distribution that is static with respect to the rotor shaft, the plurality of balance masses arranged only at one side of the at least one cutting blade, the plurality of balance masses including a first balance mass and a second balance mass being configured and arranged for compensating the imbalance of the at least one cutting blade with respect to its rotational movement;

wherein a spacing between the second balance mass and the at least one cutting blade is at least double a spacing between the first balance mass and the at least one cutting blade, wherein the at least one cutting blade is removably attached to a blade mount which forms the first balance mass the blade mount having an asymmetrical rotation geometry with respect to the axis of rotation, at least a portion of the first balance mass being arranged at a radial spacing from the axis of rotation which amounts to at least 75% of a smallest radius of the at least one cutting blade, the smallest radius part of an outer circumference of the at least one cutting blade.

14. An apparatus for the slicing of food products comprising:

at least one cutting blade rotating about a single axis of rotation and having an imbalance with respect to its rotational movement about the single axis of rotation;

a rotary drive for the at least one cutting blade, the rotary drive comprising a drive disk and a rotor shaft, the drive disk interacting with a drive motor via a drive belt, the drive disk in direct interaction with the drive belt, the rotor shaft connected between the drive disk and the at least one cutting blade; and a counterweight comprising a plurality of balance masses axially spaced apart from one another, the axially spaced balance masses being configured and arranged for compensating the imbalance of the at least one cutting blade with respect to its rotational movement;

wherein one of the axially spaced balance masses is formed by the drive disk of the rotary drive which can be set into rotation by means of the drive motor via the drive belt.

* * * * *